US008395551B2

(12) United States Patent
Huang

(10) Patent No.: US 8,395,551 B2
(45) Date of Patent: Mar. 12, 2013

(54) ANTENNA MODULE AND ELECTRONIC DEVICE USING THE SAME

(75) Inventor: Chin-Ting Huang, Taipei (TW)

(73) Assignee: Pegatron Corporation, Beitou District, Taipei (TW)

( * ) Notice: Subject to any disclaimer, the term of this patent is extended or adjusted under 35 U.S.C. 154(b) by 367 days.

(21) Appl. No.: 12/843,059

(22) Filed: Jul. 26, 2010

(65) Prior Publication Data

US 2011/0037663 A1 Feb. 17, 2011

(30) Foreign Application Priority Data

Aug. 13, 2009 (TW) ..... 98127291 A

(51) Int. Cl.
*H01Q 1/38* (2006.01)
*H01Q 1/36* (2006.01)

(52) U.S. Cl. ..... 343/700 MS; 343/702; 343/895

(58) Field of Classification Search ..... 343/700 MS, 343/702, 846, 895
See application file for complete search history.

(56) References Cited

U.S. PATENT DOCUMENTS

| | | | | |
|---|---|---|---|---|
| 7,482,991 | B2 | 1/2009 | Boyle | |
| 7,501,983 | B2 | 3/2009 | Mikkola | |
| 7,728,776 | B2 * | 6/2010 | Lin et al. | 343/702 |
| 7,791,546 | B2 * | 9/2010 | Hotta et al. | 343/702 |
| 7,804,457 | B2 * | 9/2010 | Oshiyama et al. | 343/749 |

FOREIGN PATENT DOCUMENTS

| | | | |
|---|---|---|---|
| CN | 1452272 | A | 10/2003 |

* cited by examiner

*Primary Examiner* — Hoang V Nguyen
(74) *Attorney, Agent, or Firm* — Winston Hsu; Scott Margo

(57) ABSTRACT

This invention provides an antenna module and an electronic device using the same. The antenna module includes a signal feeding part, a ground part, and a first asymmetric meander line. One terminal of the first asymmetric meander line is connected with the signal feeding part, the other terminal is connected with the ground part, and the first asymmetric meander line does not meander toward its inner side. A signal is fed in via the signal feeding part to allow the first asymmetric meander line to excite a first resonance frequency. An area of the antenna module in the invention is smaller than that of a conventional planar antenna, and the antenna module can generate an inductive effect to improve antenna radiation efficiency. Besides, since the area of the antenna module is small, a metal electronic component in the electronic device and the antenna module won't overlap thus to reduce interference.

24 Claims, 9 Drawing Sheets

ANTENNA MODULE AND ELECTRONIC DEVICE USING THE SAME

CROSS-REFERENCE TO RELATED APPLICATIONS

This Non-provisional application claims priority under 35 U.S.C. §119(a) on Patent Application No(s). 098127291 filed in Taiwan, Republic of China Aug. 13, 2009, the entire contents of which are hereby incorporated by reference.

BACKGROUND OF THE INVENTION

1. Field of the Invention

This invention relates to an antenna module and an electronic device using the same and, more particularly, to an antenna module with a small area and an electronic device using the same.

2. Description of the Related Art

In recent years, with fast development of global handheld wireless communications industry, cell phones are developed from dual-band (such as a global system for mobile communications 900 (GSM900)/a digital cellular system (DCS)) cell phones with a simple telephoning function in an early period to tri-band (such as GSM900/DCS/personal communications service (PCS)) and even to quad-band (such as GSM900/DCS/PCS/wideband code division multiplex access (WCDMA)) cell phones with a video telephoning function. Since functions of the cell phone are gradually oriented to audio-visual entertainment, such as photographing, digital music listening, a wireless network, a global positioning system (GPS) positioning, a mobile television function and so on, volume of circuits gradually increases. However, to satisfy aesthetic, the size of the cell phone is gradually reduced, and relatively space of an antenna is usually reduced. Therefore, metal electronic components, such as a camera, a speaker, a vibrator and so on, are disposed under the antenna, and the metal electronic components may interfere with the antenna, such that signal reception quality of the antenna may also become worse due to a bad environment of the antenna.

FIG. 1 is a side view showing a conventional planar inverted-F antenna 100. In FIG. 1, the conventional planar inverted-F antenna 100 includes a metal ground surface element 101, a radiation conductor element 102, a short-circuit conductor element 103, and a signal feeding part 104. The appearance of the side structure of the planar inverted-F antenna 100 is the same as that of an inverted letter F, therefore, the antenna is named planar inverted-F antenna (abbrev., PIFA). A terminal of the radiation conductor element 102 of the antenna 100 is a short-circuit terminal formed by being connected with the metal ground surface element 101 via the short-circuit conductor element 103 at its tail terminal which is a quarter-wavelength microstrip line far from its open-circuit terminal, and the signal feeding part 104 is located between the radiation conductor element 102 and the metal ground surface element 101. Impedance matching can be achieved by adjusting a distance between the signal feeding part 104 and the short-circuit conductor element 103 to find resistance 50 Ω of a signal feed-in resonant point, and at that moment, the value of reactance ideally approximates to zero, thereby achieving the better impedance matching to excite electromagnetic radiation to transmit a signal. However, since a capacitance effect can be generated between the metal ground surface element 101 and the radiation conductor element 102, and a capacitor can store energy, the capacitance effect can reduce the energy transmission efficiency of the antenna such that a part of the energy is stored by the capacitor and the energy cannot be wholly radiated out.

Generally speaking, when a size of a conventional antenna of a cell phone is $40.0\times20.0\times7.0$ mm$^3$, the four bands GSM900/DCS/PCS/WCDMA can be wholly covered. Therefore, the conventional antenna is unfavorable for light, slim, short, and small development of the cell phone. Besides, since the size of the antenna is great, the metal electronic components may fail to keep away from the antenna thus to interfere with the antenna and to affect the signal reception quality.

BRIEF SUMMARY OF THE INVENTION

This invention provides an antenna module. The antenna module includes a signal feeding part, a ground part, and a first asymmetric meander line. One terminal of the first asymmetric meander line is connected with the signal feeding part, the other terminal of the first asymmetric meander line is connected with the ground part, and the first asymmetric meander line does not meander toward its inner side. A signal is fed in via the signal feeding part to allow the first asymmetric meander line to excite a first resonance frequency.

In one embodiment of the invention, the antenna module may further include a first conductor branch, a second conductor branch, and a frame. The first conductor branch is connected with the first asymmetric meander line and includes a first open-circuit terminal, and the first conductor branch is allowed to excite a second resonance frequency after the signal is fed in via the signal feeding part; the second conductor branch is connected with the first asymmetric meander line and includes a second open-circuit terminal, and the second conductor branch is allowed to excite a third resonance frequency after the signal is fed in via the signal feeding part. The frame is used for supporting the first asymmetric meander line, the first conductor branch, and the second conductor branch.

In one embodiment of the invention, the signal feeding part and the ground part may be disposed at a first plane, the first asymmetric meander line may extend along a second plane connected with the first plane, and the first plane and the second plane may form an angle.

In one embodiment of the invention, a width of the second plane occupied by the first conductor branch, the second conductor branch, and the first asymmetric meander line may be less than 10 mm.

In one embodiment of the invention, the second plane occupied by the first conductor branch, the second conductor branch, and the first asymmetric meander line may be a plane formed by a plurality of rectangles, and a width of one of the rectangles may be less than 10 mm.

The invention provides an electronic device. The electronic device includes a transceiver chip module and an antenna module. The antenna module includes a signal feeding part, a ground part, and a first asymmetric meander line. The signal feeding part is connected with the transceiver chip module. One terminal of the first asymmetric meander line is connected with the signal feeding part, the other terminal of the first asymmetric meander line is connected with the ground part, and the first asymmetric meander line does not meander toward its inner side. A signal is fed in via the signal feeding part to allow the first asymmetric meander line to excite a first resonance frequency.

In one embodiment of the invention, the electronic device may further include at least one metal electronic component, and the metal electronic component and the antenna module may not overlap. The metal electronic component may be a camera, a vibrator, or a speaker.

According to the above, the invention provides an antenna module. The antenna module has the first asymmetric meander line connected between the signal feeding part and the ground part. The first asymmetric meander line can allow the area needed by the antenna module to be reduced and can generate an inductive effect thus to counteract an existent capacitance effect of the antenna module, thereby improving antenna radiation efficiency. On the other hand, since the area of the antenna module is reduced, the metal electronic component in the electronic device can keep away from the antenna module. Besides, the antenna module further includes the first conductor branch and the second conductor branch, such that the operation frequency of the antenna module can cover four bands of GSM900 (880 to 960 MHz)/DCS (1710 to 1880MHz)/PCS (1850 to 1990 MHz)/WCDMA (1920 to 2170 MHz), the antenna radiation efficiency can be more than 60%, and the volume of the antenna module can be effectively reduced by more than 40%.

These and other features, aspects, and advantages of the present invention will become better understood with regard to the following description, appended claims, and accompanying drawings.

DETAILED DESCRIPTION OF THE INVENTION

Figure 1:
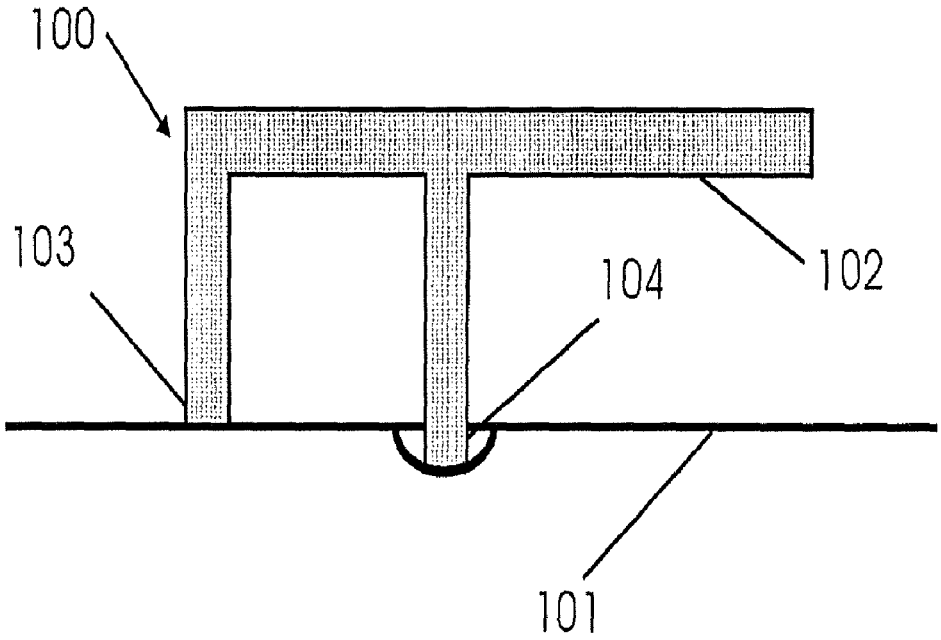
FIG. 1 (Prior Art)
FIG. 1 is a side view showing a conventional planar inverted-F antenna.
Figure 2A:
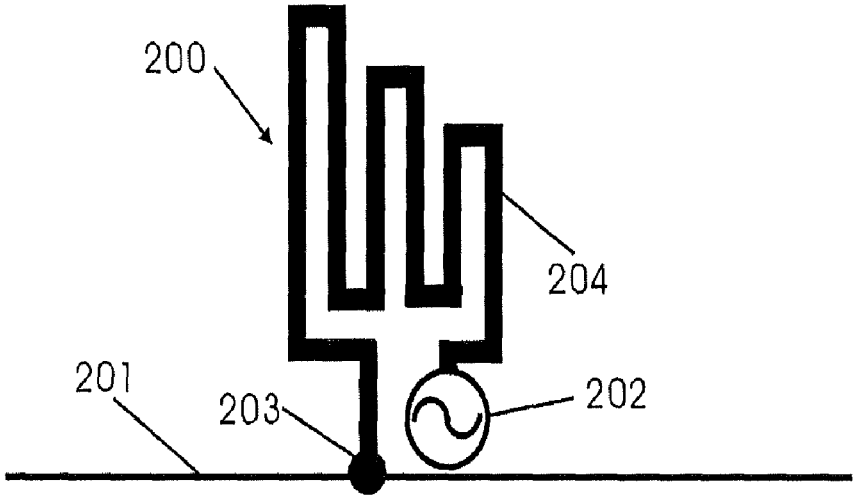
FIG. 2A is a planar diagram showing an antenna module according to one embodiment of the invention.

First, please refer to FIG. 2A. FIG. 2A is a planar diagram showing an antenna module 200 according to one embodiment of the invention. The antenna module 200 includes a metal ground surface 201, a signal feeding part 202, a ground part 203, and a first asymmetric meander line 204. The ground part 203 is connected with the metal ground surface 201, and the ground part 203 can be a short-circuit wire. One terminal of the first asymmetric meander line 204 is connected with the signal feeding part 202, the other terminal of the first asymmetric meander line 204 is connected with the ground part 203, and the first asymmetric meander line 204 does not meander toward its inner side.

The first asymmetric meander line 204 can allow the area needed by the antenna module 200 to be reduced and can generate an inductive effect thus to counteract an existent capacitance effect of the antenna module 200, thereby improving antenna radiation efficiency. In the embodiment, a signal is fed in via the signal feeding part 202 to allow the first asymmetric meander line 204 to excite a first resonance frequency. Further, the length of the first asymmetric meander line 204 is a length meandering from the signal feeding part 202 to the ground part 203, i.e., the length of the first asymmetric meander line 204 is equal to a half of a wavelength corresponding to the first resonance frequency.

Besides, the first asymmetric meander line 204 does not meander toward the inner side, which means that the first asymmetric meander line 204 is an open meander line. An asymmetric meander line 214 meandering toward its inner side is compared with the first asymmetric meander line 204 thus to further describe the meaning that the first asymmetric meander line 204 does not meander toward the inner side.

Figure 2B:
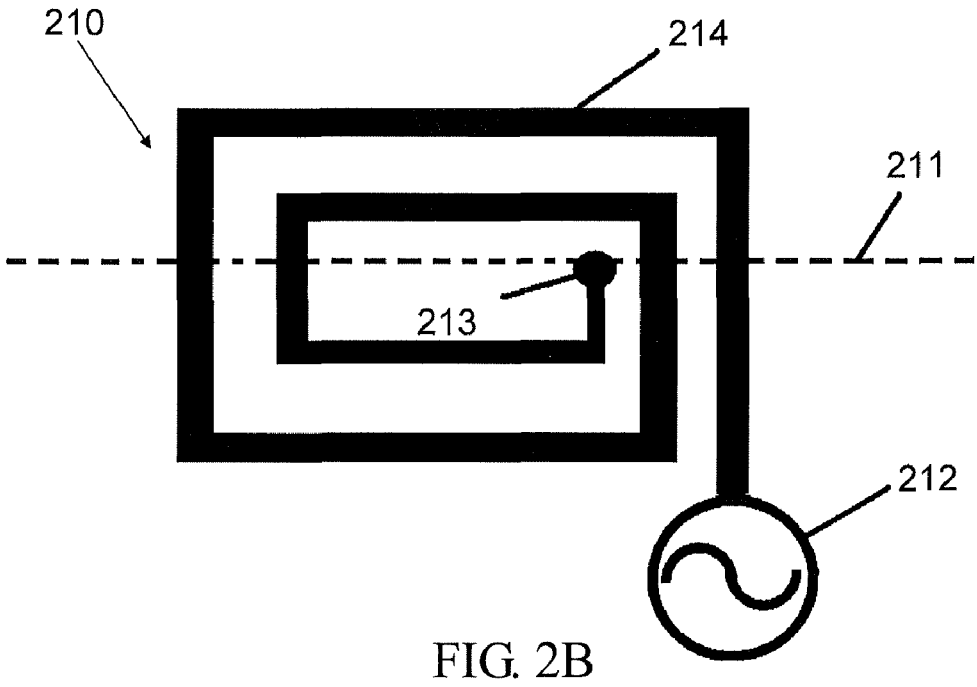
FIG. 2B is a planar diagram showing an antenna module compared with the antenna module according to one embodiment of the invention.

FIG. 2B is a planar diagram showing an antenna module 210 compared with the antenna module 200 according to the embodiment of the invention. In FIG. 2B, the antenna module 210 includes a metal ground surface 211, a signal feeding part 212, a ground part 213, and an asymmetric meander line 214. The asymmetric meander line 214 in FIG. 2B meanders toward its inner side and it is a closed meander line. The meandering mode of the asymmetric meander line 214 can allow one terminal point to be surrounded by the asymmetric meander line 214, and the meandering mode from the signal feeding part 212 to the ground part 213 is toward the inner side. Therefore, the asymmetric meander line 214 in FIG. 2B and meander lines with similar meandering modes are called meander lines meandering toward its inner side. In contrast with the asymmetric 214, the first asymmetric meander line 204 in the present invention and meander lines with similar meandering modes are called meander lines not meandering toward its inner side.

The meandering number, shape, and size of the first asymmetric meander line of the antenna module in the embodiment of the invention are not limited to those of the first asymmetric meander line 204 in FIG. 2A. In other words, the meandering number, shape, size of the first asymmetric meander line can be freely designed according to needs. Further, the antenna module 200 can only receive or transmit a wireless signal with the first resonance frequency and it belongs to the antenna module with a single band. However, a current wireless communications apparatus can mostly use an antenna to receive and transmit wireless signals in multiple bands. Therefore, an antenna module capable of receiving and transmitting wireless signals in dual bands is described hereinbelow.

Figure 3:
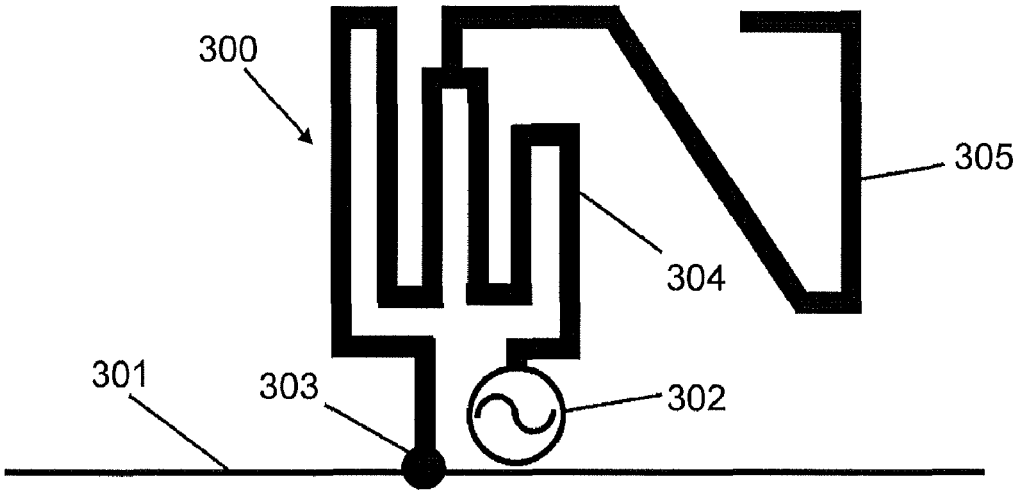
FIG. 3 is a planar diagram showing an antenna module according to one embodiment of the invention.

FIG. 3 is a planar diagram showing an antenna module 300 according to one embodiment of the invention. In FIG. 3, the antenna module 300 includes a metal ground surface 301, a signal feeding part 302, a ground part 303, a first asymmetric meander line. 304, and a first conductor branch 305. The difference between the antenna module 300 and the antenna module 200 in FIG. 2A is that the antenna module 300 additionally includes the first conductor branch 305. One terminal of the first conductor branch 305 is open, and the first conductor branch 305 is connected with the first asymmetric meander line 304.

The connection position of the first conductor branch 305 and the first asymmetric meander line 304 is not limited, and the first conductor branch 305 in the demonstrated embodiment is not a meander line. In the embodiment, a signal is fed in via the signal feeding part 302 to allow the first asymmetric meander line 304 to excite a first resonance frequency, and allow the first conductor branch 305 to excite a second resonance frequency. Besides, the length of the first asymmetric meander line 304 is equal to a half of a wavelength corresponding to the first resonance frequency, and the length of the first conductor branch 305 (the length from the signal feeding part 302 to a first open-circuit terminal of the first conductor branch 305) is equal to a quarter of a wavelength corresponding to the second resonance frequency. Therefore, the antenna module 300 can receive and transmit a dual-band wireless signal with the first resonance frequency and the second resonance frequency.

Figure 4:
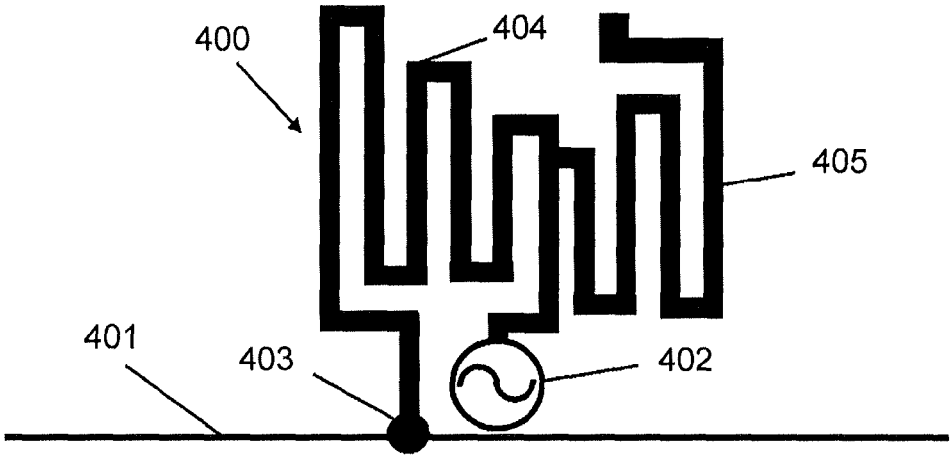
FIG. 4 is a planar diagram showing an antenna module according to one embodiment of the invention.
Figure 5:
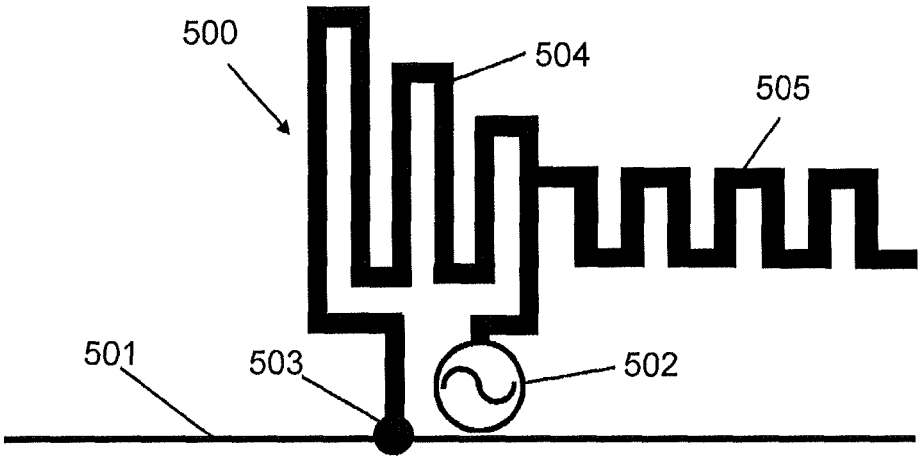
FIG. 5 is a planar diagram showing an antenna module according to one embodiment of the invention.

In addition, the first conductor branch can further be a symmetric meander line and can also be a second asymmetric meander line to reduce the area of the antenna module. Please refer to FIG. 4 and FIG. 5, FIG. 4 is a planar diagram showing an antenna module 400 according to one embodiment of the invention. FIG. 5 is a planar diagram showing an antenna module 500 according to one embodiment of the invention. In FIG. 4, the antenna module 400 includes a metal ground surface 401, a signal feeding part 402, a ground part 403, a first asymmetric meander line 404, and a first conductor branch 405. The first conductor branch 405 is a second asymmetric meander line, and the second asymmetric meander line does not meander toward its inner side. In FIG. 5, the antenna module 500 includes a metal ground surface 501, a signal feeding part 502, a ground part 503, a first asymmetric meander line 504, and a first conductor branch 505. The first conductor branch 505 is a symmetric meander line, and the symmetric meander line does not meander toward its inner side. That is, the forms of the first conductor branches 405, 505 are not limited.

Figure 6:
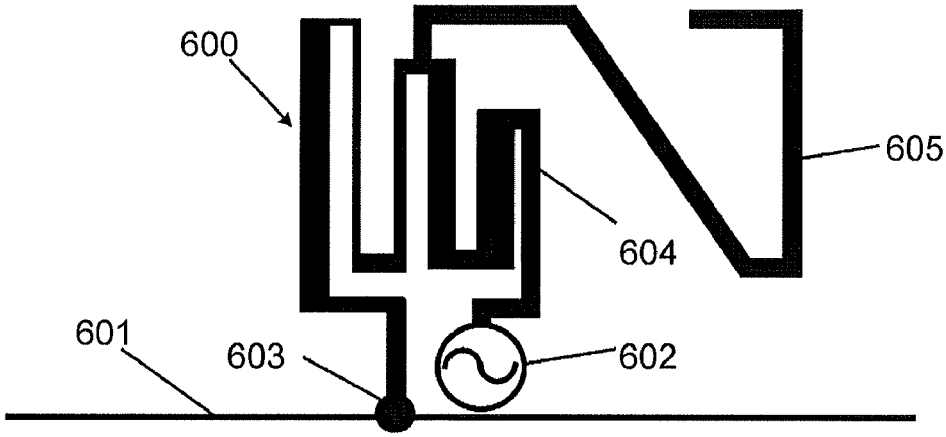
FIG. 6 is a planar diagram showing an antenna module according to one embodiment of the invention.

Materials of the first conductor branch, the second conductor branch, and the first asymmetric meander line can include a first conductive material, and the first conductive material may be a metal wire. Besides, the first conductor branch, the second conductor branch, and the first asymmetric meander line can be metal wires with a uniform line width and can also be wires with a non-uniform line width. Please refer to FIG. 6. FIG. 6 is a planar diagram showing an antenna module 600 according to one embodiment of the invention. The antenna module 600 includes a metal ground surface 601, a signal feeding part 602, a ground part 603, a first asymmetric meander line 604, and a first conductor branch 605. In this embodiment, the first asymmetric meander line 604 has a non-uniform line width. In a word, the line width of the first conductor branch, the second conductor branch, and the first asymmetric meander line is not limited in the invention.

Figure 7:
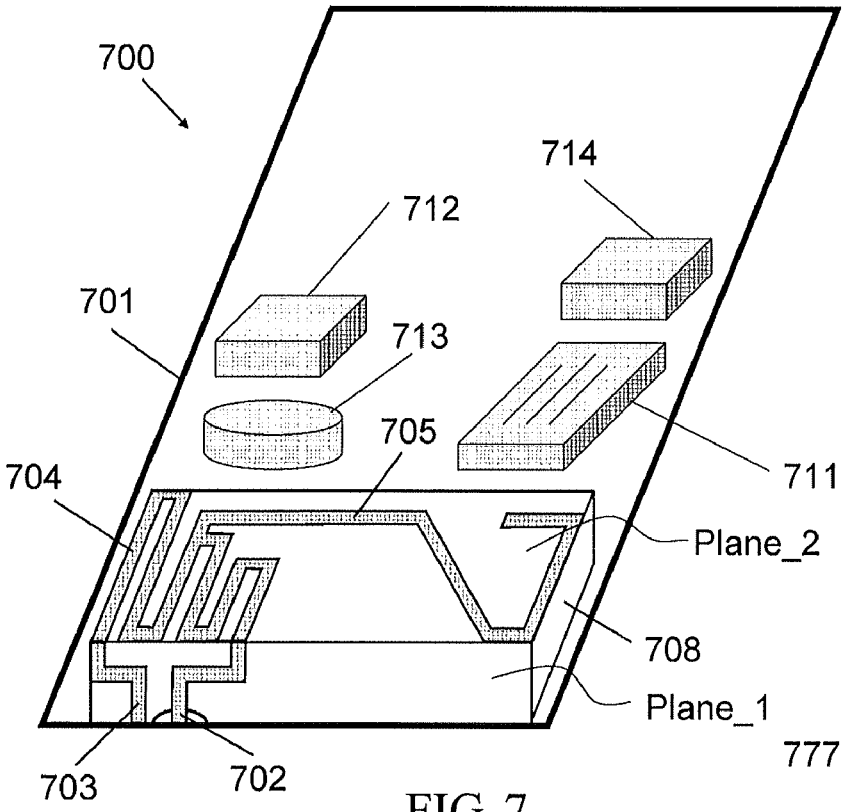
FIG. 7 is a schematic diagram showing a part of an electronic device according to one embodiment of the invention.

Then, please refer to FIG. 7. FIG. 7 is a schematic diagram showing a part of an electronic device 777 according to one embodiment of the invention. The electronic device 777 includes a transceiver chip module 714, an antenna module 700, a speaker 711, a vibrator 712, and a camera 713. The transceiver chip module 714 is connected with the antenna module 700 via a metal wire (not shown). The transceiver chip module 714 itself can have a control interface, and the control interface can further be connected with the speaker 711, the vibrator 712, and the camera 713 via metal wires (not shown).

The antenna module 700 includes a metal ground surface 701, a signal feeding part 702, a ground part 703, a first asymmetric meander line 704, a first conductor branch 705, and a frame 708. The ground part 703 is connected with the metal ground surface 701, and the ground part 703 can be a short-circuit wire. One terminal of the first asymmetric meander line 704 is connected with the signal feeding part 702, the other terminal of the first asymmetric meander line 704 is connected with the ground part 703, and the first asymmetric meander line 704 does not meander toward its inner side. One terminal of the first conductor branch 705 is open, and the first conductor branch 705 is connected with the first asymmetric meander line 704. The frame 708 is used for supporting the first asymmetric meander line 704 and the first conductor branch 705. A material of the frame 708 includes a second conductive material or a non-conductive material, materials of the first conductor branch 705 and the first asymmetric meander line 704 include a first conductive material, and dielectric coefficients of the first conductive material and the second conductive material are different. In the embodiment, the signal feeding part 702 and the ground part 703 are disposed at a first plane Plane_1, the first asymmetric meander line 704 extends along a second plane $Plane_{13}$ 2 connected with the first plane $Plane_{13}$ 1, and the first plane Plane_1 and the second plane Plane_2 form an angle.

The speaker 711, the vibrator 712, and the camera 713 are metal electronic components. The area of the conventional planar antenna is large; therefore, the metal electronic components in the electronic device need to be disposed under the planar antenna. Further, interference may be generated to reduce antenna radiation efficiency because the metal electronic components cannot keep away from the planar antenna. However, the antenna module 700 includes the first asymmetric meander line 704 to allow the occupied area to be greatly reduced, the speaker 711, the vibrator 712, and the camera 713 can keep away from the antenna module 700, such that interference to the antenna module 700 is not generated easily. In other words, the metal electronic components, such as the speaker 711, the vibrator 712, and the camera 713 and so on, and the antenna module 700 do not overlap.

In addition, only a part of the electronic device 777 is shown in FIG. 7. Actually, the electronic device 777 may include other components which are not shown in FIG. 7. In the embodiment, the electronic device 777 may be a cell phone, a personal digital assistant (PDA), a mini-notebook, or a wireless communications apparatus and so on.

Figure 8:
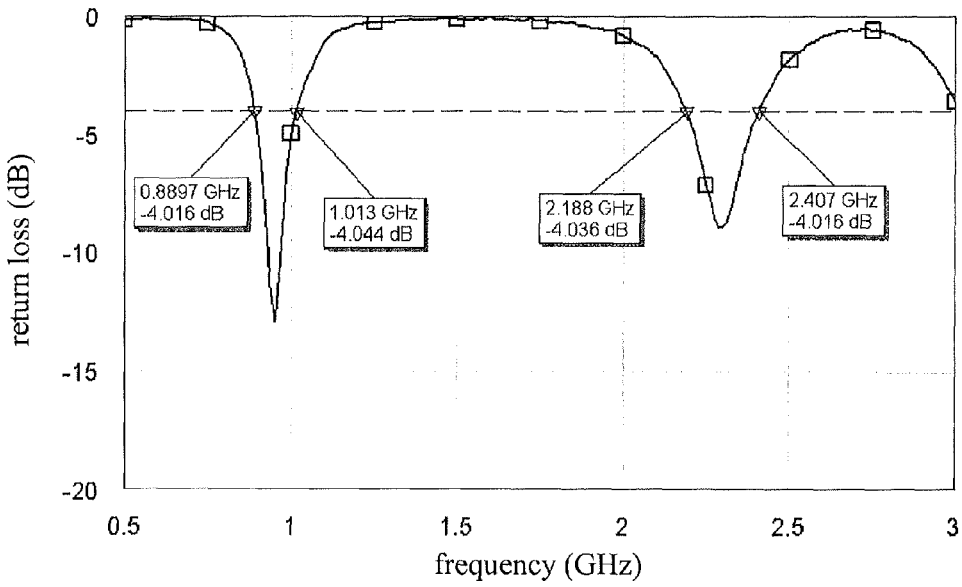
FIG. 8 is a curve graph showing return loss of an antenna module according to one embodiment of the invention.

Please refer to FIG. 8. FIG. 8 is a curve graph showing return loss of the antenna module 700 according to one embodiment of the invention. The antenna module 700 can excite wireless signals with a first resonance frequency and a second resonance frequency. The center frequency of the band of the first resonance frequency is about 951 MHz, the frequency range thereof is about 889 to 1013 MHz, and the bandwidth thereof is 124 MHz. Further, the center frequency of the band of the second resonance frequency is about 2298 MHz, the frequency range thereof is about 2188 to 2407 MHz, and the bandwidth thereof is 219 MHz.

Although the number of the conductor branch of the above antenna module is only one, the number of the conductor branch of the antenna module is not limited in the embodiment of the invention. According to different needs, antenna designers can add a plurality of conductor branches for being connected with the first asymmetric meander line thus to receive and transmit wireless signals in multiple bands.

Figure 9:
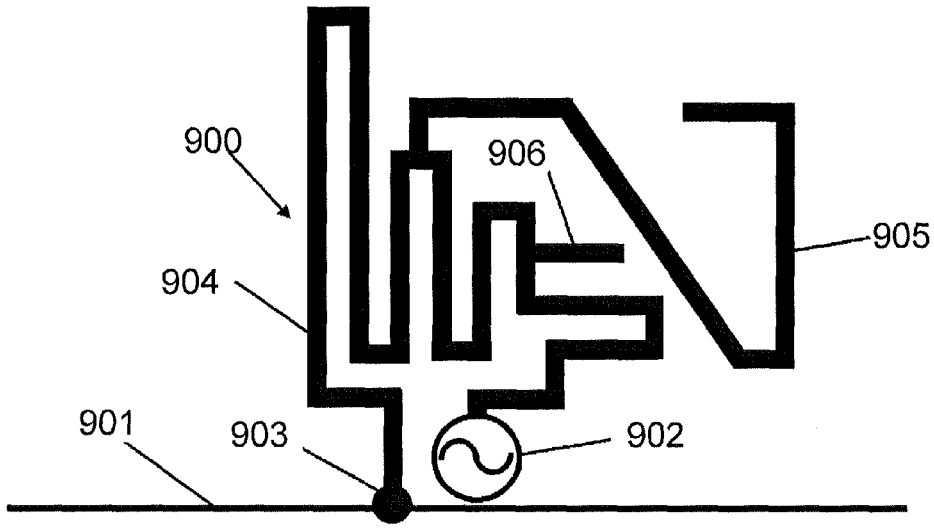
FIG. 9 is a planar diagram showing an antenna module according to one embodiment of the invention.

Please refer to FIG. 9. FIG. 9 is a planar diagram showing an antenna module 900 according to one embodiment of the invention, the antenna module 900 further includes a second conductor branch 906 besides including a metal ground surface 901, a signal feeding part 902, a ground part 903, a first asymmetric meander line 904, and a first conductor branch 905. One terminal of the second conductor branch 906 is open, and the second conductor branch 906 is connected with the first asymmetric meander line 904.

In the embodiment, a signal is fed in via the signal feeding part 902 to allow the first asymmetric meander line 904 to excite a first resonance frequency and allow the first conductor branch 905 to excite a second resonance frequency, and at the same time, the second conductor branch 906 can be allowed to excite a third resonance frequency. Further, the length of the second conductor branch 906 (the length from the signal feeding part 902 to a second open-circuit terminal of the second conductor branch 906) is equal to a quarter of a wavelength corresponding to the third resonance frequency. The antenna module 900 can receive and transmit wireless signals in at least three bands, and the frequency range of the third resonance frequency can further include a plurality of bands of a communications system. Therefore, the antenna module 900 can substantially receive and transmit the wireless signals in at least four bands.

Figure 10A:
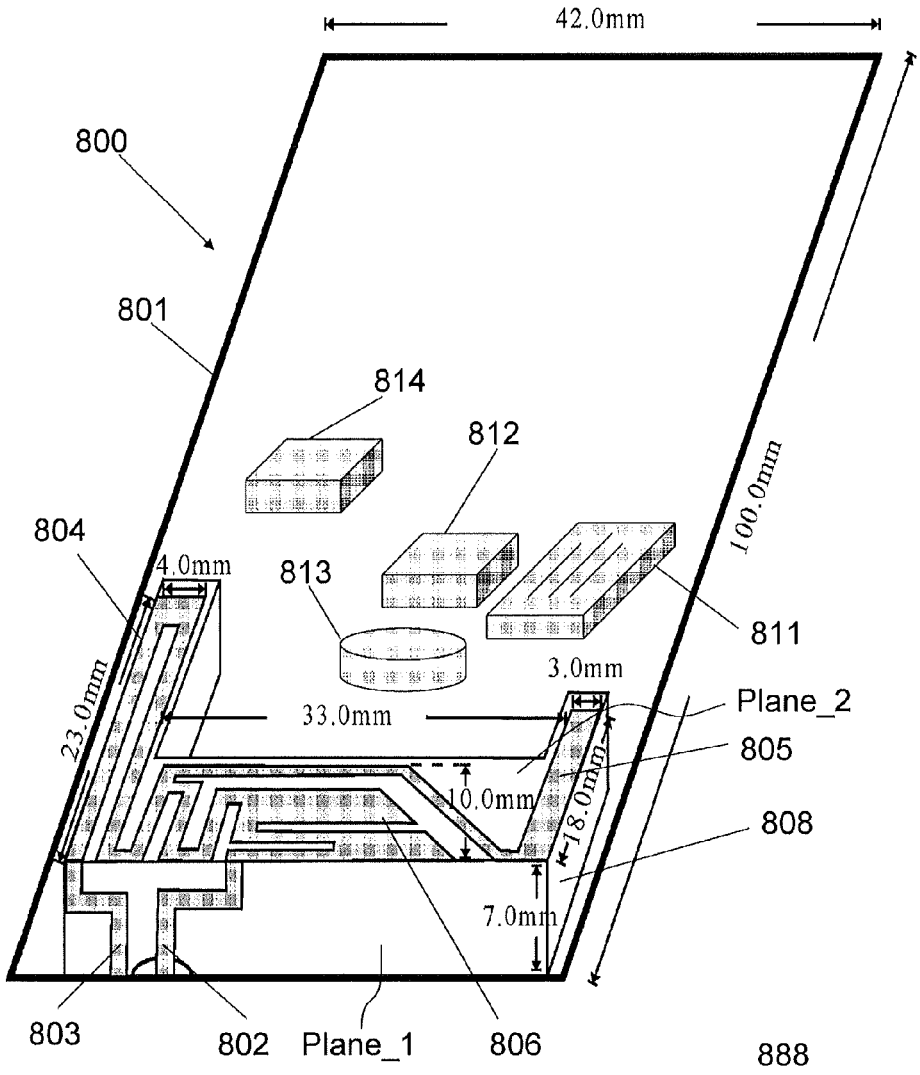
FIG. 10A is a schematic diagram showing a part of an electronic device according to one embodiment of the invention.

Please refer to FIG. 10A. FIG. 10A is a schematic diagram showing a part of an electronic device 888 according to one embodiment of the invention. The electronic device 888 includes a transceiver chip module 814, an antenna module 800, a speaker 811, a vibrator 812, and a camera 813. The antenna module 800 includes a metal ground surface 801, a signal feeding part 802, a ground part 803, a first asymmetric meander line 804, a first conductor branch 805, a second conductor branch 806, and a frame 808. A material of the frame 808 includes a second conductive material or a non-conductive material, materials of the first conductor branch 805, the second conductor branch 806, and the first asymmetric meander line 804 include a first conductive material, and dielectric coefficients of the first conductive material and the second conductive material are different.

The speaker 811, the vibrator 812, and the camera 813 are metal electronic components, and the speaker 811, the vibrator 812, and the camera 813 can keep away from the antenna module 800, such that interference to the antenna module 800 is not generated easily. In the embodiment, the signal feeding part 802 and the ground part 803 are disposed at a first plane Plane_1, the first asymmetric meander line 804 extends along a second plane $Plane_{13}$ 2 connected with the first plane Plane_1, and the first plane $Plane_{13}$ 1 and the second plane $Plane_{13}$ 2 form an angle. The second plane Plane_2 occupied by the first conductor branch 805, the second conductor branch 806, and the first asymmetric meander line 804 is a plane formed by a plurality of rectangles, and a width of one of the rectangles is less than 10 mm. In detail, the plane occupied by the first conductor branch 805, the second conductor branch 806, and the first asymmetric meander line 804 is a plane formed by a rectangle of $23.0\times4.0\ mm^2$, a rectangle of $33.0\times10.0\ mm^2$, and a rectangle of $18.0\times3.0\ mm^2$. Further, in the embodiment, the height of the frame 808 is 7.0 mm.

Figure 10B:
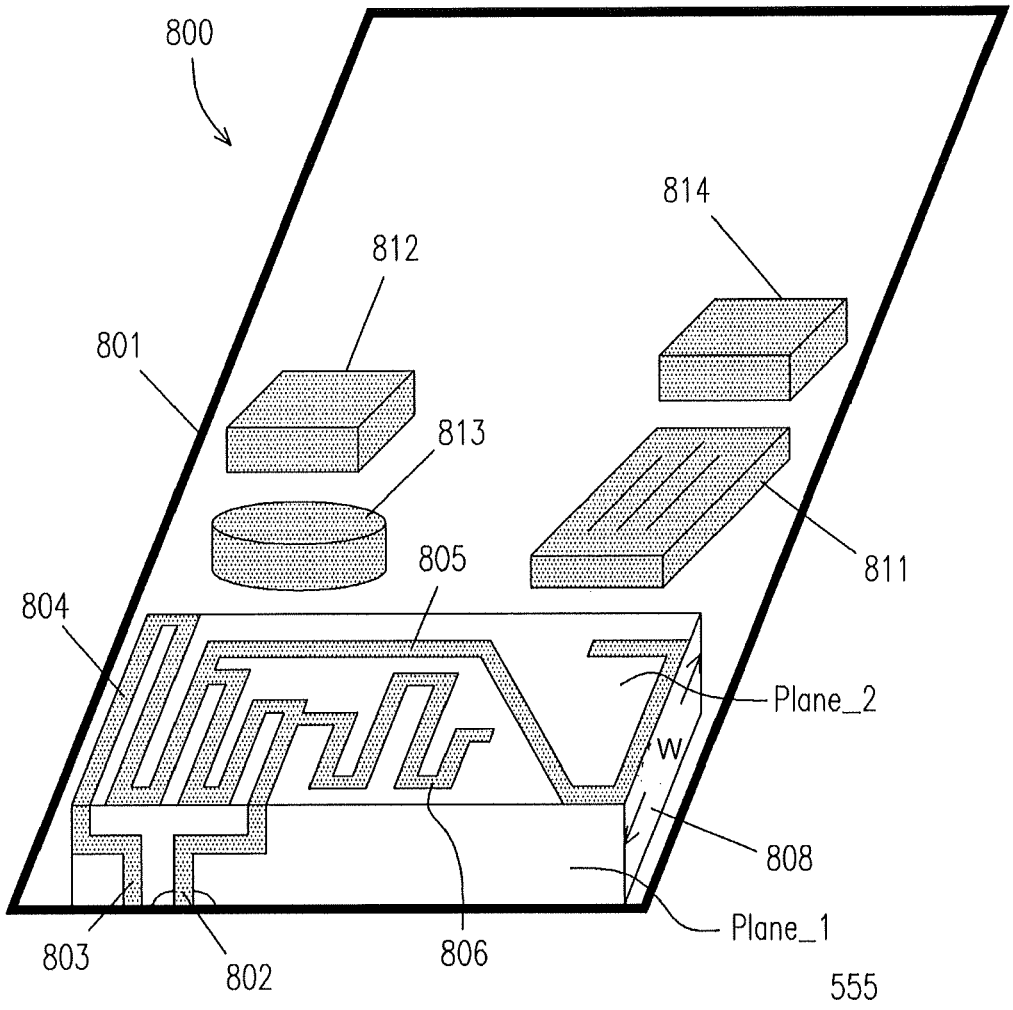
FIG. 10B is a schematic diagram showing a part of an electronic device according to one embodiment of the invention.

The form of the antenna module 800 is not limited to the above description. Please refer to FIG. 10B. FIG. 10B is a schematic diagram showing a part of an electronic device 555 according to one embodiment of the invention. The second plane $Plane_{13}$ 2 occupied by the first conductor branch 805, the second conductor branch 806, and the first asymmetric meander line 804 can be formed by a single rectangle while the signal feeding part 802 and the ground part 803 are disposed at the first plane Plane_1, the first asymmetric meander line 804 extends along the second plane $Plane_{13}$ 2 connected with the first plane Plane_1, and the first plane $Plane_{13}$ 1 and the second plane $Plane_{13}$ 2 form the angle. A width W of the second plane $Plane_{13}$ 2 is less than 10 mm. However, the size of the antenna module 800 in FIG. 10A and FIG. 10B can also be adjusted according to different needs. In the embodiment of the invention, the size of the antenna module is not limited, and the antenna module 800 in the embodiment as shown in FIG. 10B can save many areas.

Figure 11:
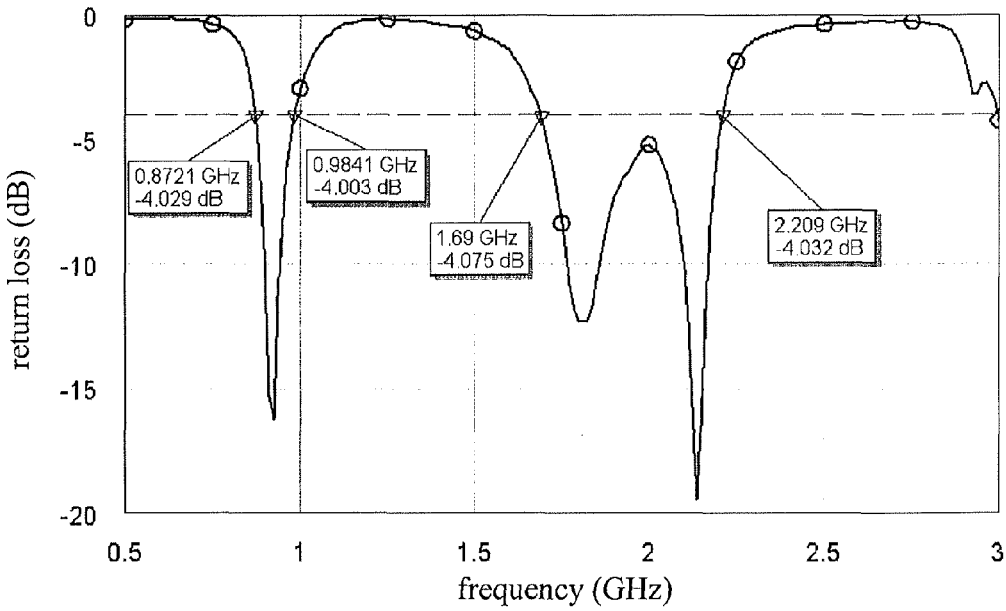
FIG. 11 is a curve graph showing return loss of an antenna module according to one embodiment of the invention.

Further, please refer to FIG. 11. FIG. 11 is a curve graph showing return loss of the antenna module 800 according to the embodiment of the invention. The antenna module 800 can excite wireless signals with a first resonance frequency, a second resonance frequency, and a third resonance frequency. The center frequency of the band of the first resonance frequency is about 928 MHz, the frequency range thereof is about 872 to 984 MHz, and the bandwidth thereof is 112 MHz. Further, the center frequency of the band formed by the second resonance frequency and the third resonance frequency is about 1950 MHz, the frequency range thereof is about 1690 to 2209 MHz, and the bandwidth thereof is 519 MHz. In other words, the operation frequency of the antenna module 800 can cover four bands of GSM900 (880 to 960 MHz)/DCS (1710 to 1880 MHz)/PCS (1850 to 1990 MHz)/WCDMA (1920 to 2170 MHz).

Figure 12:
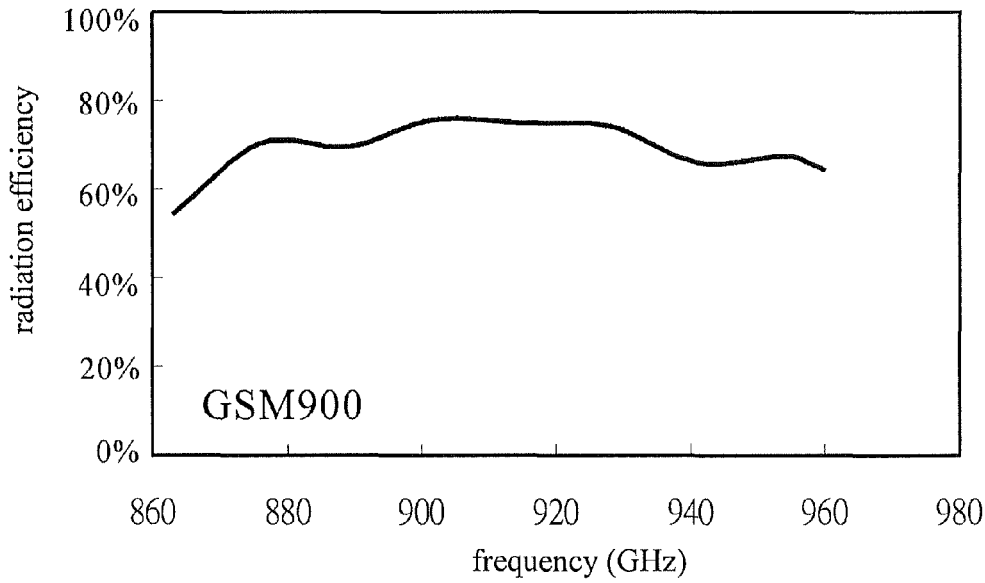
FIG. 12 is a curve graph showing antenna radiation efficiency of an antenna module in a band of GSM900 according to one embodiment of the invention.
Figure 13:
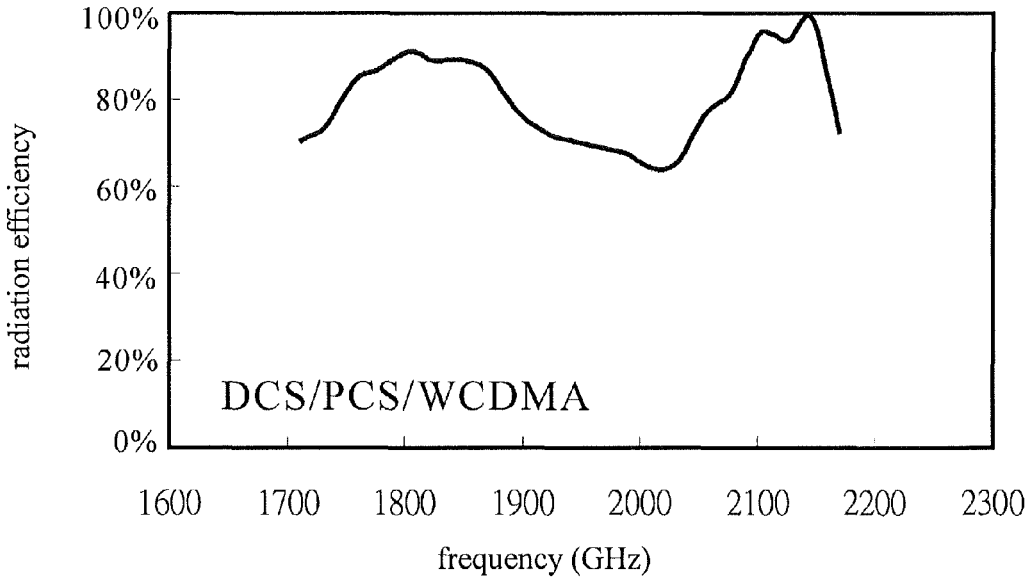
FIG. 13 is a curve graph showing antenna radiation efficiency of an antenna module in bands of DCS/PCS/WCDMA according to one embodiment of the invention.

Please refer to FIG. 12 and FIG. 13. FIG. 12 is a curve graph showing antenna radiation efficiency of the antenna module 800 in a band of GSM900 according to the embodiment of the invention. FIG. 13 is a curve graph showing the antenna radiation efficiency of the antenna module 800 in bands of DCS/PCS/WCDMA according to the embodiment of the invention. According to FIG. 12 and FIG. 13, the antenna radiation efficiency of the antenna module 800 can be at least more than 60%.

To sum up, the antenna module in the embodiment of the invention includes the first asymmetric meander line not meandering toward the inner side from the signal feeding part to the ground part. The antenna module can reduce the needed area, and the first asymmetric meander line can further generate the inductive effect to reduce the capacitance efficiency stored by the antenna module, thereby improving the antenna radiation efficiency. Besides, since the area needed by the antenna module is reduced, when the metal electronic components of the electronic device are disposed, the metal electronic components can keep away from the antenna module thus to reduce the effect and interfere of the metal electronic components to the antenna module.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An antenna module comprising:

a signal feeding part;

a ground part; and a first asymmetric meander line, one terminal of the first asymmetric meander line connected with the signal feeding part, the other terminal of the first asymmetric meander line connected with the ground part, the first asymmetric meander line not meandering toward its inner side, wherein a signal is fed in via the signal feeding part to allow the first asymmetric meander line to excite a first resonance frequency.

2. The antenna module according to claim 1, further comprising:

a first conductor branch connected with the first asymmetric meander line and including a first open-circuit terminal, the first conductor branch being allowed to excite a second resonance frequency after the signal is fed in via the signal feeding part.

3. The antenna module according to claim 2, wherein the first conductor branch is a second asymmetric meander line.

4. The antenna module according to claim 2, wherein the first conductor branch is a symmetric meander line.

5. The antenna module according to claim 2, further comprising:

a second conductor branch connected with the first asymmetric meander line and including a second open-circuit terminal, the second conductor branch being allowed to excite a third resonance frequency after the signal is fed in via the signal feeding part.

6. The antenna module according to claim 5, wherein the signal feeding part and the ground part are disposed at a first plane, the first asymmetric meander line extends along a second plane connected with the first plane, and the first plane and the second plane form an angle.

7. The antenna module according to claim 6, wherein a width of the second plane occupied by the first conductor branch, the second conductor branch, and the first asymmetric meander line is less than 10 mm.

8. The antenna module according to claim 6, wherein the second plane occupied by the first conductor branch, the second conductor branch, and the first asymmetric meander line is a plane formed by a plurality of rectangles, and a width of one of the rectangles is less than 10 mm.

9. The antenna module according to claim 5, further comprising:

a frame, supporting the first asymmetric meander line, the first conductor branch, and the second conductor branch.

10. The antenna module according to claim 9, wherein materials of the second conductor branch, the first conductor branch, and the first asymmetric meander line include a first conductive material, a material of the frame includes a second conductive material or a non-conductive material, and dielectric coefficients of the first conductive material and the second conductive material are different.

11. The antenna module according to claim 2, wherein the first asymmetric meander line has a non-uniform line width.

12. An electronic device comprising:

a transceiver chip module; and an antenna module including a signal feeding part, a ground part, and a first asymmetric meander line, wherein the signal feeding part is connected with the transceiver chip module, one terminal of the first asymmetric meander line is connected with the signal feeding part, the other terminal of the first asymmetric meander line is connected with the ground part, the first asymmetric meander line does not meander toward its inner side, and a signal is fed in via the signal feeding part to allow the first asymmetric meander line to excite a first resonance frequency.

13. The electronic device according to claim 12, wherein the electronic device further comprises at least one metal electronic component, and the metal electronic component and the antenna module do not overlap.

14. The electronic device according to claim 13, wherein the metal electronic component is a camera, a vibrator, or a speaker.

15. The electronic device according to claim 12, wherein the antenna module further comprises:

a first conductor branch connected with the first asymmetric meander line and including a first open-circuit terminal, the first conductor branch being allowed to excite a second resonance frequency after the signal is fed in via the signal feeding part.

16. The electronic device according to claim 15, wherein the first conductor branch is a second asymmetric meander line.

17. The electronic device according to claim 15, wherein the first conductor branch is a symmetric meander line.

18. The electronic device according to claim 15, wherein the antenna module further comprises:

a second conductor branch connected with the first asymmetric meander line and including a second open-circuit terminal, the second conductor branch being allowed to excite a third resonance frequency after the signal is fed in via the signal feeding part.

19. The electronic device according to claim 18, wherein the signal feeding part and the ground part are disposed at a first plane, the first asymmetric meander line extends along a second plane connected with the first plane, and the first plane and the second plane form an angle.

20. The electronic device according to claim 19, wherein a width of the second plane occupied by the first conductor branch, the second conductor branch, and the first asymmetric meander line is less than 10 mm.

21. The electronic device according to claim 19, wherein the second plane occupied by the first conductor branch, the second conductor branch, and the first asymmetric meander line is a plane formed by a plurality of rectangles, and a width of one of the rectangles is less than 10 mm.

22. The electronic device according to claim 18, further comprising:

a frame, supporting the first asymmetric meander line, the first conductor branch, and the second conductor branch.

23. The electronic device according to claim 22, wherein materials of the second conductor branch, the first conductor branch, and the first asymmetric meander line include a first conductive material, a material of the frame includes a second conductive material or a non-conductive material, and dielectric coefficients of the first conductive material and the second conductive material are different.

24. The electronic device according to claim 15, wherein the first asymmetric meander line has a non-uniform line width.

* * * * *